US006343657B1

(12) United States Patent
Baugh et al.

(10) Patent No.: US 6,343,657 B1
(45) **Date of Patent: *Feb. 5, 2002**

(54) METHOD OF INJECTING TUBING DOWN PIPELINES

(75) Inventors: Benton F. Baugh, Houston, TX (US); James R. Crawford, Lafayette, LA (US)

(73) Assignee: Superior Energy Services, LLC., New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/185,988

(22) Filed: Nov. 4, 1998

Related U.S. Application Data

(60) Provisional application No. 60/066,380, filed on Nov. 21, 1997, and provisional application No. 60/067,503, filed on Dec. 4, 1997.

(51) Int. Cl.[7] ..... E21B 17/10

(52) U.S. Cl. ..... 166/383; 166/384; 166/241.1; 166/241.6; 405/184

(58) Field of Search ..... 166/383, 384, 166/77.2, 241.1, 241.4, 241.6, 77.3; 405/154, 184

(56) References Cited

U.S. PATENT DOCUMENTS

| | | | | |
|---|---|---|---|---|
| 3,467,196 A | | 9/1969 | Kinsman et al. | 166/315 |
| 3,827,487 A | | 8/1974 | Jackson et al. | 166/77 |
| 4,585,061 A | | 4/1986 | Lyons et al. | 166/77 |
| 4,729,429 A | | 3/1988 | Wittrisch | 166/65.1 |
| 5,180,009 A | * | 1/1993 | Sneed | 166/155 |
| 5,188,174 A | | 2/1993 | Anderson et al. | 166/77 |
| 5,309,990 A | | 5/1994 | Lance | 166/77 |
| 5,309,993 A | | 5/1994 | Coon et al. | 166/115 |
| 5,316,094 A | | 5/1994 | Pringle | 175/74 |
| 5,494,103 A | | 2/1996 | Surjaatmadja et al. | 166/222 |
| 5,566,764 A | | 10/1996 | Elliston | 166/385 |
| 5,692,563 A | | 12/1997 | Krueger et al. | 166/85.5 |
| 5,695,009 A | | 12/1997 | Hipp | 166/196 |
| 5,704,393 A | | 1/1998 | Connell et al. | 137/614.21 |
| 5,992,250 A | * | 11/1999 | Kluth et al. | 73/866.5 |

FOREIGN PATENT DOCUMENTS

| | | | |
|---|---|---|---|
| EP | 0 187 599 | 7/1986 | E21B/23/10 |
| GB | 1132503 | 11/1968 | E21B/41/00 |

OTHER PUBLICATIONS

PCT Search Report PCT/US98/24723.

* cited by examiner

*Primary Examiner*—William Neuder
(74) *Attorney, Agent, or Firm*—Garvey, Smith, Nehrbass & Doody, LLC

(57) ABSTRACT

A new method and apparatus have been developed which inserts and withdraws tubing from pipes without bending or kinking the tubing. Beneficially, the new method and apparatus may be employed to insert and withdraw tubing to depths greater than ever possible before. The method involves using a thruster pig to provide force to inject the tubing, and skate apparatuses to reduce coiling and friction of the tube. Advantageously, the apparatus is portable, easily handled, and adaptable to handle tubing of differing diameters.

17 Claims, 5 Drawing Sheets

METHOD OF INJECTING TUBING DOWN PIPELINES

CROSS REFERENCE TO PATENTS

This application claims priority from provisional patent application Ser. No. 60/066,380 filed on Nov. 21, 1997, entitled "Method and Apparatus of Injecting Coil Tubing Down Pipelines," and provisional patent application Ser. No. 60/067,503 filed on Dec. 4, 1997, entitled "Method and Apparatus of Injecting Coil Tubing Down Pipelines."

FIELD OF THE INVENTION

The instant invention relates to a method of injecting tubing down a pipe or open hole. In particular, the instant invention relates to a method of injecting coiled tubing down a pipe in deep water to service the pipeline, i.e., to remove paraffinic blockages, hydrates, scale, or solid debris from the pipe. More particularly, the instant invention relates to a method of injecting tubing into a pipe where a substantial portion of the pipe is horizontal and the total injected length is greater than about 6,000 feet (1,830 meters).

BACKGROUND OF THE INVENTION

In the development and production of subterranean hydrocarbon deposits and other energy sources there are many occasions when it is necessary to insert an elongated tube from the surface deep into a pipe or open hole. These pipes or holes may be vertical, horizontal, curved, or combinations of these and may be part of, for example, a well, pipe line, production line, or drill pipe. The inserted tube has an outer diameter that is smaller than the inner diameter of the pipe or open hole. The insertion of the tube may be for purposes of, for example, removing blockages or general servicing.

Often during repair or servicing of a pipe a rig capable of handling long lengths of straight screw-type pipes is not available. In many cases the strength of larger diameter straight screwed tubing is not needed so the cost of running this type of tube is not justifiable. In these cases it is often advantageous to use a long, continuous injected tubing called coiled tubing. Many apparatuses have been developed to insert or inject a continuous length of relatively thin walled steel tubing into a pipe or open hole from a large reel or spool on the surface.

Large forces are often necessary to insert and withdraw thousands of feet or more of steel tubing into a pipe or open hole which may be filled with hydrocarbons or other materials. Most current apparatuses focus on the injector head located where the smaller tubing is injected into the larger tubing. The injector head grips the tubing along its length and, in conjunction with a motor, guides and forces the tubing into the pipe via, for example, a dual, opposed conveyor belt on the surface of the well. Typical injector heads are described in, for example, U.S. Pat. Nos. 3,827,487; 5,309,990; 4,585,061; 5,566,764; and 5,188,174. These patents are incorporated here by reference.

Unfortunately, the apparatuses of these patents are problematic in many respects. One problem is that the tubing may be bent or kinked, i.e., the tubing becomes helical, down the well due to the large forces pushing against it and the weight of the tubing itself. This is especially problematic when the pipe is deviated from vertical. As the pipe becomes more horizontal, the weight of the coiled tubing itself no longer acts as a force pulling the tubing along, but instead acts against the wall of the pipe, creating friction. In addition, the weight of the tube no longer acts to straighten the coiled tubing, and the coil encourages coiling in the pipe. This coil, coupled with friction, results in increased force between the coiled tube and the inner diameter of the pipe and effectively binds the tubing. As a result of this and other problems, such prior art devices cannot effectively insert more than about 3,000 to about 5,000 feet (900 to 1500 meters) of tubing in substantially horizontal pipe.

Another typical problem with prior art devices is that the injector equipment associated with such devices is often relatively heavy, difficult to move, and complex due to a large chain assembly of machinery that serves as a conveyor belt to force the tubing into the pipe.

One method of reducing friction in injected tubing is the tubing friction reducer described in U.S. Pat. No. 5,692,563. This patent describes a friction reducer containing multiple bearings set in legs extending outward from a body. The patent specifies that bearings of about 0.2188 inches in diameter can be used. Use of these bearings would give a clearance of about 0.1 inches or less between the tip of the bearing and the holding leg. In addition, this patent describes friction reducing devices with 12 or more rows of wheels. Applicants found that the described friction reducer embodiments were not applicable for larger diameter coiled tubing, in that the designs did not have the mechanical strength needed to support tubing. For example, the patent states that the friction reducer could be made of a metal such as aluminum, plastic, rubber, or other composites, and the ball bearings in one embodiment are of Teflon. Applicants found that molded steel bodies with a minimum number of welds were necessary to circumvent tight turns in a pipe without breaking. Applicants found certain very durable composites, such as polysulfone, could be used as wheel material only for very light service. For normal service, steel wheels are required. Finally, applicants found that sludge and oil in a pipeline would freeze the bearings described in the '563 patent. Conventional testing assumes a relative high contact stress with the oil lubricity assisting, but with the oil viscosity as a non-factor. In the low-loading characteristics of coiled tubing, the viscosity can be a factor several times that of friction. Therefore, the devices described in U.S. Pat. No. 5,692,563 were not deemed operable for heavier coiled tubing or for pipe with obstructions.

Other methods have been employed to increase the length to which tubing can be injected. U.S. Pat. No. 5,704,393 describes an apparatus that can be set in the well at the end of the coiled tubing string at a determinable location. The apparatus is a valve apparatus, a packer apparatus, and a connector. Seals allow the coiled tubing, but not fluid, to move in a centrally located bore through the packer apparatus. The apparatus is immobile against the outer pipeline, and has the ability restrict or prevent fluid flow. Once the packer is set, the annular pressure, i.e., the pressure differential between the pipeline and the interior of the coiled tubing, is increased by injecting fluid into the annular volume. This increased pressure stiffens and straightens the coiled tubing, allowing for increased distance of injection of coiled tubing into the pipeline.

It is apparent that what is needed in the art is a method for readily inserting and withdrawing tubing from a pipe for long distances, i.e., greater than about 6,000 feet (1830 meters), without bending or kinking the tubing. It would be beneficial if such a method could be employed to insert and withdraw tubing from a substantially horizontal pipe of extended length of greater than 6,000 feet (1830 meters), and that the tubing can extend past turns. Moreover, it would be of great benefit if such an apparatus was portable, easily handled, and could be adapted to handle tubing of differing diameters.

BRIEF SUMMARY OF THE INVENTION

A new method has been developed for inserting and withdrawing tubing from pipes or open holes. Beneficially, the new method may be employed to insert and withdraw tubing to lengths of over 6000 feet (1830 meters), preferably greater than 26,000 feet (9900 meters), and more preferably greater than 60,000 feet (18,300 meters). Advantageously, the method uses an apparatus that is portable, easily handled, and adaptable to handle tubing of differing diameters.

The method comprises feeding a coil tubing into a pipe that has a larger diameter than the coil tubing. The injected tubing has a thruster pig located at or near the distal end of the injected tubing. The thruster pig utilizes a pressure differential across the thruster pig to generate force needed to inject tubing down a pipe or well. The thruster pig device is attached to the tubing, and is as a practical matter usually attached near, i.e., within about 2000 feet, preferably within 100 feet, of the distal end of the tubing. The body of the thruster pig has a outer diameter greater than the outer diameter of the injected tubing and equal to or smaller than the inner diameter of the pipe. The thruster pig has a sealing apparatus, for example one or more chevrons, to impede fluid migration between the body of the thruster pig and the inner surface of the pipe. This effectively creates an annulus between the injected tubing and the pipe so pressure can be applied to the rear of the thruster pig. The thruster pig has an attaching apparatus for attaching the device to the end of the small diameter tubing or to the exterior of the small diameter tubing. The thruster pig has an opening that allows fluids pumped down the center of the injected tubing to pass to the front of the thruster pig. Finally, the thruster pig has a means for allowing fluids to flow from the annulus through the device as the thruster pig is being withdrawn.

After the thruster pig is inside the pipe, at least a portion of the force needed to inject the tubing into the pipe is provided by pressure exerted on the annulus between the pipe and the injected tube and therefore also exerted on the back of the thruster pig. The pressure differential between the front of the thruster pig and the rear of the thruster pig provides force to inject the tubing into the pipe.

The injected tubing also has one or more skate apparatuses attached to the tubing at predetermined intervals. The skate has a body diameter greater than the diameter of the injected tubing and has a cylindrical port capable of fitting around a portion of the injected tubing. The body opens length-wise by an amount sufficient to insert the injected tubing. This allows the skate apparatus to securely fit around the outer diameter of the injected tubing. There is a means of fastening the skate to the outer diameter of the injected tube. Finally, there is a set of three to six, preferably three to four, rigid arms extending in a plane in a direction toward the interior surface of the pipe. Each of the arms contains one or more wheels on the distal end of the arms. "In a plane" means that there is a cross-section of the skate that will include at least a portion of the three to four arms that radiate out from the body. There may be more than one set of three to four arms on a body, provided the sets are displaced axially along the body from one another.

The wheels are capable of movable communication with the inner surface of the pipe. The radius from the center of the injected tubing to the outermost edge of the wheels or rollers is not smaller than 0.5 times the radius of the pipe. The skate maintains a portion of the tubing in the center of the pipe such that the movement-restricting force for at least a portion of the injected tubing is rolling friction rather than a combination of sliding friction and the force needed to overcome the shear viscosity of the fluid within the pipe.

The instant invention also is a method for withdrawing the injected tubing from the pipe. The method comprises opening a normally closed aperture through the body of the thruster pig to allow fluid migration from the annulus to the pipe that is ahead of the thruster pig. Optionally, an equalizing valve can be run in the thruster pig, or the coiled tubing can be opened at the reel to eliminate the annular force on the thruster pig as it is removed from the pipe line or well. In some cases, such as thrusting the coiled tubing into the pipe or well with an electric line inside of the pipe, these valves can be opened or closed using the electric power available.

Optionally, pressure may be exerted through the injected tubing to the pipe ahead of the thruster pig until the pressure is greater than the pressure in the annulus behind the thruster pig. This provides a portion of the force needed to withdraw the injected tubing from the pipe.

DETAILED DESCRIPTION OF THE INVENTION

A new method has been developed for inserting and withdrawing tubing from pipes or open holes without bending or kinking the tubing. Beneficially, the new method may be employed to insert and withdraw tubing to lengths of over 6000 feet, preferably over 26,000 and more preferably over 60,000 feet. Advantageously, the apparatus is portable, easily handled, and adaptable to handle tubing of differing diameters.

The method involves attaching a thruster pig to the distal end of the injected tubing, and then injecting this tubing into the pipe using pressure exerted against the back of the thruster pig to provide at least a fraction of the force needed to inject the tubing. The method also involves attaching one or more skate apparatuses at predetermined intervals along the injected tubing.

As used herein, the term "injected tubing" includes tubing or screwed pipe injected into other pipe. The coiled tubing or pipe may be of any diameter such as 1 inch, 1.25 inch, 1.5 inc., 1.75 inch, 2 inch, 2.375 inch or greater. The size of the coiled tubing or pipe is determined by the size of the pipe line or wellbore and the purpose for inserting the tubing. Several reels of coiled tubing may be joined together to inject to greater lengths than a single reel can reach. The coiled tubing reels can be connected to provide a continuous string of tubing for extended reach service. They can also be connected to help overcome weight restrictions that may be encountered on some locations where it would be impossible to lift a reel of pipe with more than 50,000 foot of pipe on it. These reels are connected by methods known to the art. The injected tubing may be coiled or jointed pipe, i.e., straight pipe joined by, for example, standard oil field threaded unions such as CS Hydril. The injected tubing may be joints of traditional tubing used in oilfield drilling and production operations, such as 2.375 inch nominal outer diameter tubing.

As used herein, the term "pipe" includes any steel or other pipe or tubing into which the tubing is injected. While pipes and open holes may be any shape, typically, they are substantially cylindrical. As a practical matter, the pipe can be 2 inch to about 24 inch or greater nominal outer diameter pipe. The pipe may be threaded or welded. A portion of the pipe is partially horizontal.

As used herein, the term "partially horizontal" includes pipe, continuous tubing or pipe, and open holes in which a fraction of the pipe or tubing has a vertical rise over run of about 0.6 or less measured in the direction so that both rise and run are positive units of length. The pipe may include sections where the rise over run is greater than 0.6 and may include turns. The pipe may include wells where some portion of the well is deviated from vertical.

Figure 1:
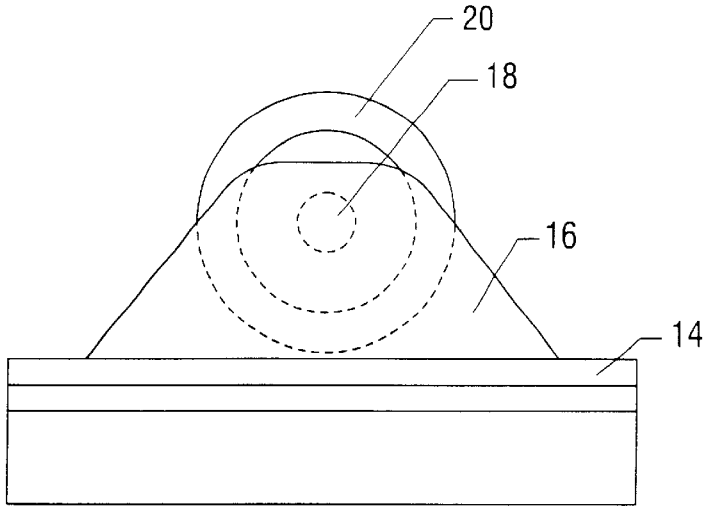
FIG. 1 is a diagram of an arm and wheel on a skate apparatus.

FIG. 1 is a diagram of an arm and wheel on a skate apparatus. As shown in FIG. 1, the wheel 20 is attached to the preferably beveled arm 16 with an axle 18. The three arms, only one of which is shown, are attached to the cylindrical body 14 in a plane. The dimensions of the arms are not critical, but an arm such as shown will not tend to become stuck by obstructions in the pipe while traveling in a forward or reverse direction. Applicants found that, when there are obstructions in the line, having only three or four legs, plus the additional clearance given by larger wheels, allowed the skate apparatus to pass over the obstruction. Applicants found a skate apparatus with three legs was preferable to an apparatus with four legs.

Figure 2:
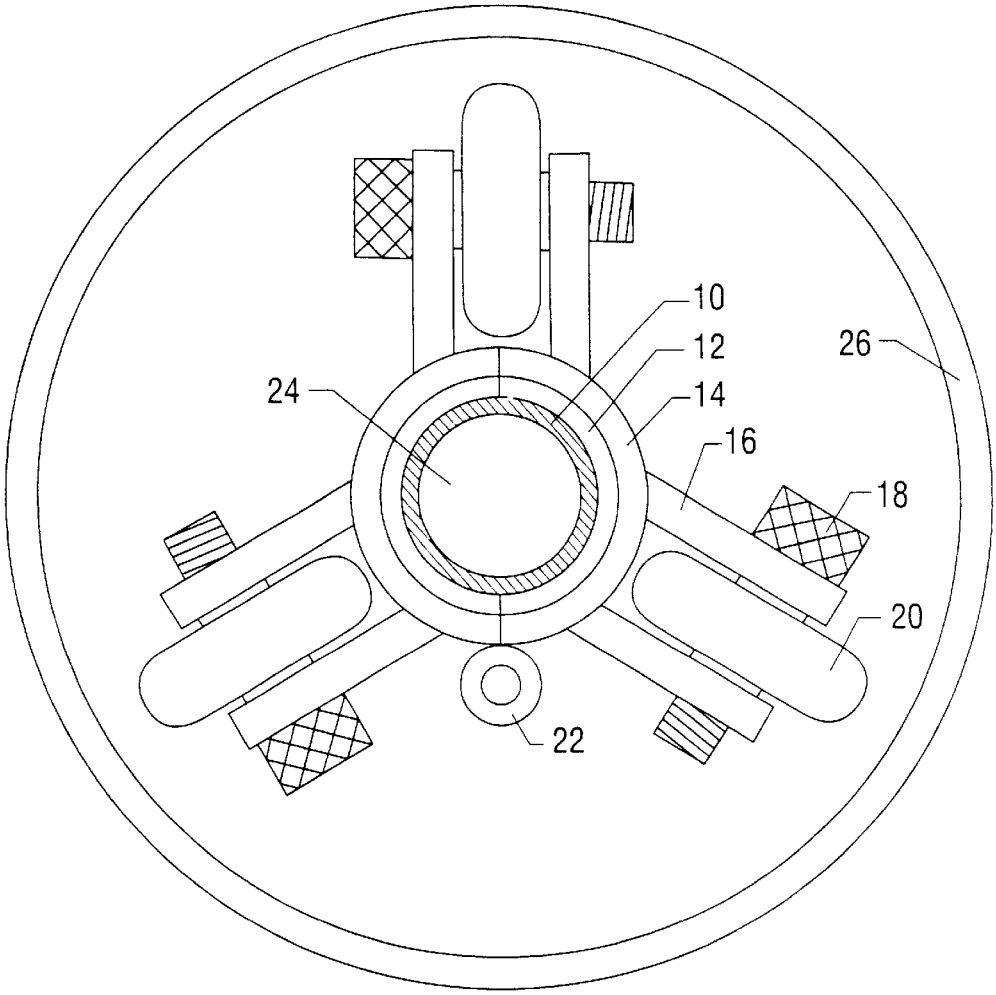
FIG. 2 is a diagram of an exemplary skate apparatus from a front-on view.

FIG. 2 is a diagram of a skate apparatus from a front-on view. As shown in FIG. 2, the injected tubing 10 has an annulus 24 where fluid can be transported. The skate has an optional sleeve 12 that allows the skate apparatus to be installed on injected tubing that is smaller than the design parameter for the skate apparatus. The cylindrical body 14 has a hinge assembly 22 and an attaching means for firmly securing the skate about the injected tubing 10. In this case, the attaching means is the axle for the wheel directly opposite the hinge assembly. The three rigid arms 16 extend radially toward the pipe 26 in a plane perpendicular to the line formed by the injected tube. The arms need only extend outward and do not need to be radial from the center of the injected tubing. The axle 18 holds the wheels 20. There may be more than one set of three or four arms and wheels on a skate if the additional set or sets are on a different cross-section of the cylindrical body.

Figure 3:
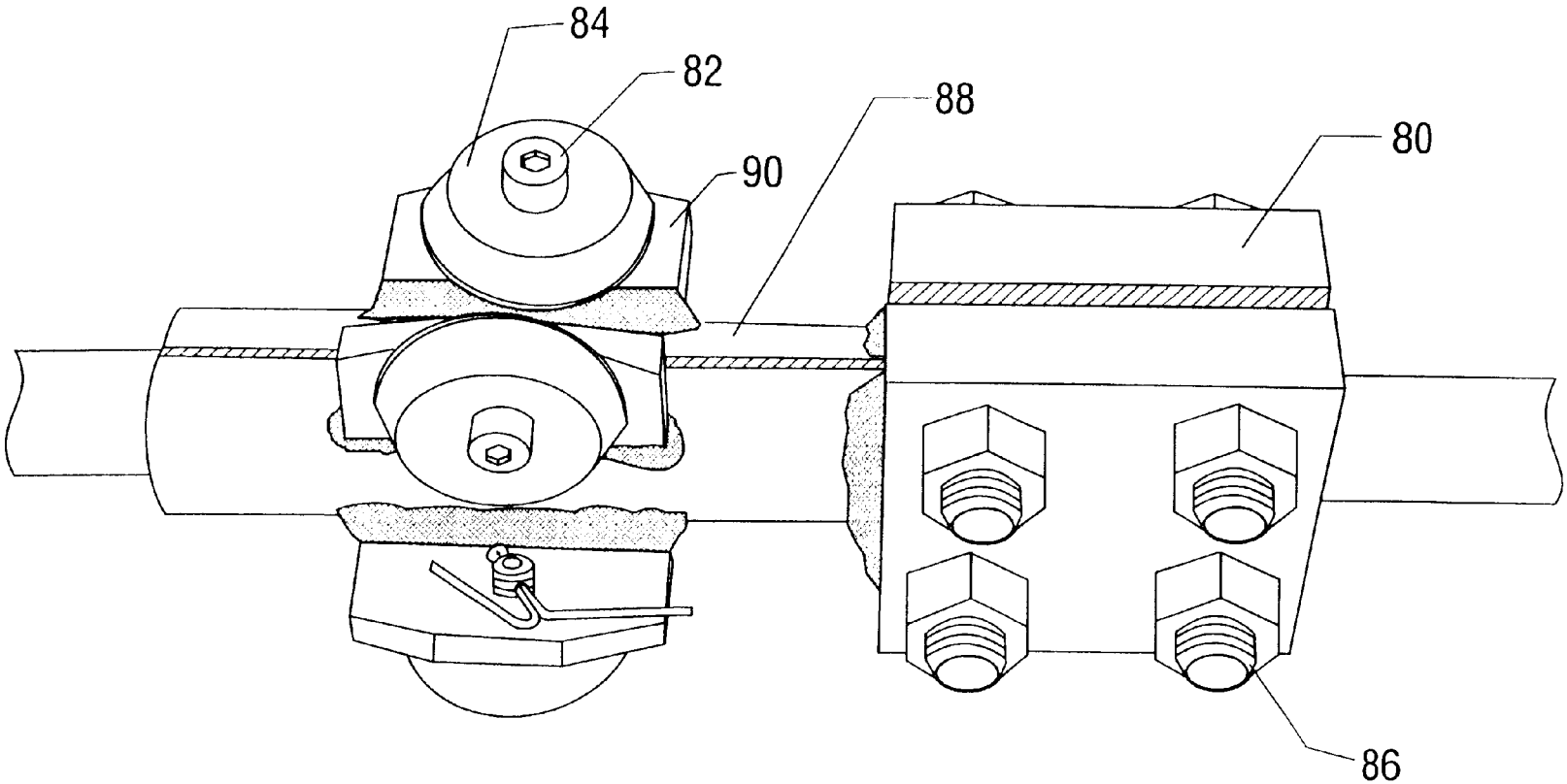
FIG. 3 and FIG. 4 are another embodiment of the skate apparatus.
Figure 4:
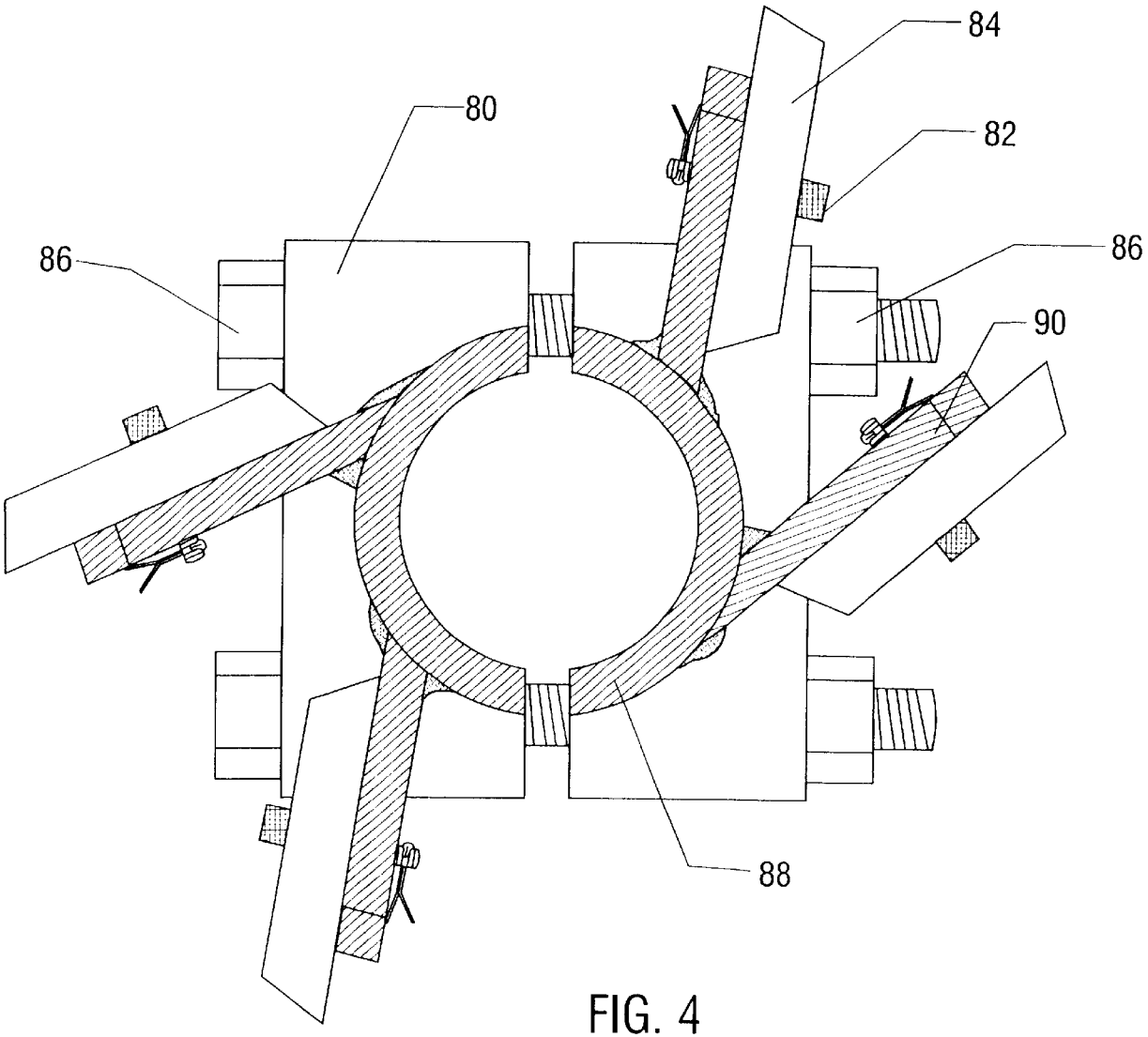

FIG. 3 and FIG. 4 are another embodiment of the skate apparatus. As shown in FIGS. 3 and 4, this skate has a attaching or gripping means 80 comprising two blocks with semicircular channels cut through and adapted to fit securely around tubing. The two blocks fit around the tubing, and are secured by four bolts 86. The blocks are integral with a body 88, which is in two pieces and is inherently slightly flexible. The body 88 holds the legs 90. There are four legs 90 attached so that the legs are skewed from radial, but still extending out toward the inner surface of the pipe. The four legs support one wheel 84 per leg. The axle 82 connects the wheel 84 to the leg 90.

Figure 5:
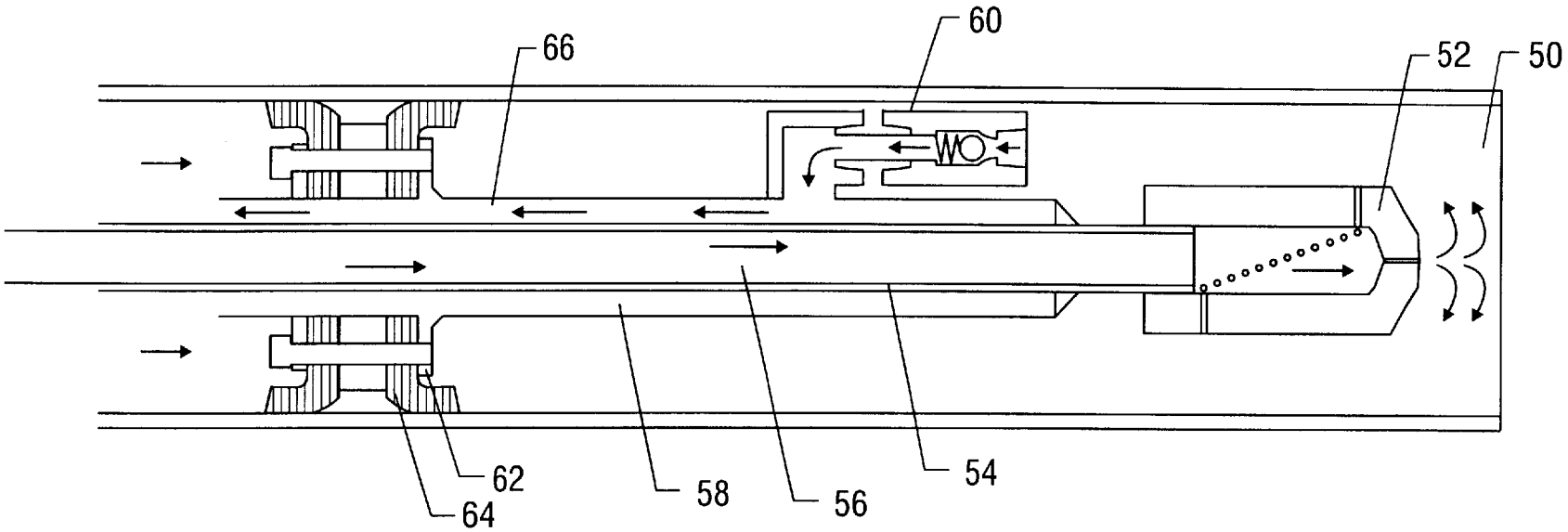
FIG. 5 is an embodiment of the thruster pig.

FIG. 5 is an embodiment of the thruster pig. As shown in FIG. 5, the thruster pig has a body 58 having a outer diameter greater than the outer diameter of the injected tubing 54. There is an attaching device (not shown) that secures the thruster pig body to the injected tubing. One or more sealing apparatuses 64 impede fluid migration between the body of the device and the inner surface of the pipe and thus create an annulus behind the thruster pig and between the injected tubing and the pipe. Aperture 56 allows fluids pumped down the interior of the injected tubing to pass through the device into the interior of the pipe ahead of the device 50. Beneficially, this injected fluid passes through a nozzle 52 that directs the fluid and adds velocity to the injected fluid. There is at least one opening 66 through the body that is normally sealed by a check valve 60. The opening 66 provides a path for fluids to flow back through the device and up the annulus. In one embodiment, the body encloses the check valves, and there is a greater number of sealing cups that extend the length of the body. The check valves 60 allow flow in a first direction against a soft spring, for example ½ psi. This direction allows fluid to flow from the front of the pig to the annulus behind the pig. Check valves 60 should also allow flow in the opposite direction, that is, for fluid to flow from behind to in front of the pig, with harder springs, for example 100 psi. If two or more thruster pigs are placed in a string and flow is pumped down the annulus, they each can provide a force of 100 psi differential times the annular piston area of the thruster pig. This force would be input into the coiled tubing at the location of the differential pigs instead of just at the ends.

Figure 6:
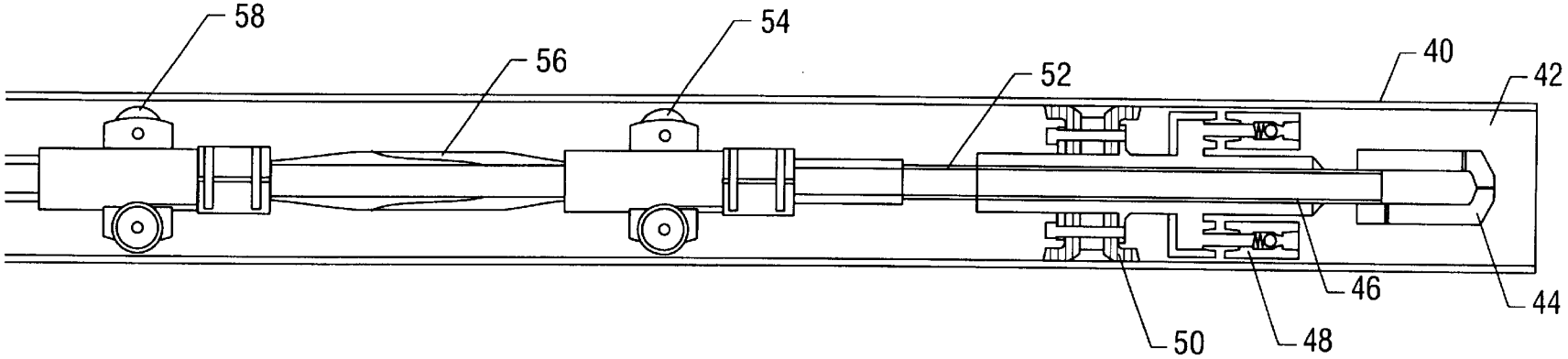
FIG. 6 is an embodiment of the thruster pig and skate apparatus in use at the same time.

FIG. 6 is an embodiment of the thruster pig and skate apparatus in use at the same time. As shown in FIG. 6, the thruster pig 46 is comprised of chevrons or cups 50 that seal against the pipe 40. The thruster pig contains a plurality, preferably four, check valves 48 that can be used to equalize the hydro-static force on the thruster pig as it is pulled back out of the well or pipe line. The check valves also allow fluid that may be pumped down the injected tubing 52 and through the nozzle head 44 to flow back up the annulus. Two skate apparatuses 54 and 58 are positioned on either side of a standard coupling/fishing neck 56. Other skate apparatuses are beneficially in place at predetermined intervals on the injected pipe. In the event the thruster pig becomes stuck, a ball injected down the injected tubing can release the coupling/fishing neck 56, which can be male or female. Once released, the thin walled injected tubing and skate 58 can be withdrawn. Then, larger or more strong tubing or a fishing hook can be injected into the pipe, can mate and attach to the fishing neck 56, and can exert a greater pulling force than could be generated with typical injected tubing.

The instant invention may utilize one or more skate apparatuses for reducing friction. The skates are advantageously spaced throughout the length of the injected tubing at predetermined intervals. The skate opens length-wise so that it can attach to the outer diameter of the injected tubing by clamping the skate apparatus to the tubing. The skates have an interior cylindrical port to fit around and firmly fix to the external surface of the tubing. This operation is usually performed below the conventional injector head so that the skate does not have to pass through the injector head. Thus, the body must open length-wise so that the injected tubing can be inserted into the port. The cylindrical body also has a means of fastening the skate to the outer diameter of the injected tube. This can be one or more hinges and clamps, or hinges and bolts, or clamps, or bolts, or other connecting mechanisms know to the art. When attached, the cylindrical port applies a compressive force to hold the skate apparatus in place on the tubing.

The pipes may be oriented vertically, horizontally, curved, or a combination of these. Necessarily, the injected tubing and skates are each able to fit within the pipes they are inserted into. The skates may be either integral to or separate from, but attached to, the tubing. It is preferable that the skates be both separate from the tube and readily removable. In this manner, the tubing may be easily coiled and stored on large, transportable reels or spools. Moreover, the skates may be removed from tubing employed in one application and installed upon tubing, perhaps of a different size, employed in another application.

The skate has a body diameter greater than the diameter of the injected tubing. The body may be separable into one or more parts when not secured to the injected tubing.

There are three to six, preferably three to four, more preferably three, rigid arms extending as a set from the cylindrical body in a direction toward the interior surface of the pipe. The set of arms are in a plane perpendicular to the cylindrical body. There may be more than one set of arms on a skate apparatus. Each of the arms contains one or more, preferably one or two, wheels on the distal end of the arms. Because the skate must fit into the pipe, the radius from the center of the injected tubing to the outermost edge of the wheels or rollers is preferably between about 0.50 to about 0.95, and more preferably between about 0.8 to about 0.9, times the radius of the pipe. Because the skate maintains a portion of the tubing in the center of the pipe, the movement-restricting force for at least a portion of the injected tubing is rolling friction rather than a combination of sliding friction and the force needed to overcome the shear viscosity of the fluid within the pipe.

The device may contain a plurality of sets of arms extending generally outward from the tubing and toward the internal surface of the pipeline. Each set of arms must be in a different cross-section of the cylindrical body. Having only three or four arms in a plane facilitates the skate moving over obstructions in the pipe. A skate with three arms in a plane was found to be preferable for moving past obstacles than a skate with four arms. A skate having one or two sets of arms in a plane is preferred over a skate with three or more sets of arms. This is because the more the sets of arms, the more prone the skate is to hanging up on obstructions in the pipe.

One or more, preferably one, wheels are attached to the outward-most end of each of the arms. The wheels are oriented to move by rolling in a direction parallel to the pipe. The wheels can engage the inner surface of the pipeline and can move relative to the internal surface. Thus, the wheels reduce the friction between the tubing/skate assembly and the pipeline compared to the tubing and the pipeline without the skate.

The specific design of the skates is not important. The skates need only attach firmly to the injected tubing. Also, at least one and preferably at least two wheels of the skates should be in movable communication with the inner walls of the pipe as the tubing is being inserted or withdrawn from the pipes. "Movable communication" means that the wheel and inner wall of the pipe are in contact so that the one or more wheels rotates clockwise as the tubing is being inserted and counterclockwise as the tubing is being withdrawn.

The material of the skate wheels should allow the wheels to readily turn when in contact with the inner diameter of the pipe in order to ease the insertion and withdrawal of the tubing. The composition of the wheels is preferably steel or, for less severe service, a polysulfone-based composite. The wheels may wear quickly in severe use, so it is advantageous for the wheels to be readily removable and changeable. The wheels may be curved or beveled on the outer face that contacts the pipe, with the radius of curvature or the bevel intended to match the curvature of the pipe. The wheels are preferably large, for example with a radius of at least one half the radius of the injected tubing.

It also may be desirable to lubricate the wheels at the axles to facilitate rotation. It may also be desirable to have bearings or other friction-reducing devices in the wheels, axle, or arms as appropriate. In a preferred embodiment, sealed bearings are installed on each set of wheels to reduce friction.

While not wishing to be bound to any particular theory, it is believed that the wheel or wheels of the skates acts to facilitate the insertion or withdrawal of the tubing in a number of ways. One way is by supporting the tubing so the tubing does not get caught on items within the pipe such as pipe connectors or other solids or obstructions that may be on the inside diameter of the pipes. Instead, the wheels allow the tubing to roll over obstructions. Moreover, by holding the tubing well away from the wall the shear viscosity of the liquid at the pipe/tubing interface is not important. The skate is therefore a shear viscosity force reducing means that eases the movement of the tubing string into the pipe. Moreover, the skates prevent helical coiling and buckling of the tubing due to frictional resistance encountered when large lengths of tubing are moved into and out of a pipe. Finally, the rolling resistance of the wheels is less than the frictional resistance of the tubing sliding against either the pipe or on a film of solid or fluid within the pipe.

One preferred embodiment is that shown in FIG. 3. The attaching means is axially displaced from the body where the legs are attached. The attaching means is two sections adapted to grip the tubing, and the two sections are held together by a plurality of bolts or, alternatively, at least one hinge and at least one bolt. The legs extend outward from the body, but at an angle near perpendicular, for example between 60 degrees and 120 degrees, to the radius of the tubing. The legs, and therefore the mounted wheels, are skewed from radial. This allows the wheels to be conveniently changed to accommodate different pipe sizes. It is preferred that the axle be positioned so that wheels varying at least 30 percent in radius or diameter can be installed on the leg while still supporting the legs from contacting the tubing. The wheels are beneficially beveled to match the interior of the pipe. It is often advantageous to have the largest wheels practicable, both so that the tubing is kept more toward the center of the pipe and so that small obstructions in the pipe do not hang up the body. If the legs and wheels are radial, there is less flexibility on wheel size selection. The wheels are preferably large, for example with a radius of at least one half the radius of the injected tubing. It is often preferred, especially for older pipes with obstructions, that the wheels have a diameter greater than, and often several times greater than, the diameter of the injected tubing. The body is preferably slightly flexible, that is, able to flex at least about 4 degrees, in response to obstructions and curves in the pipeline. The body flexibility is strong enough to support the tubing but flexible enough to adapt to the large forces generated in inserting a tube past an obstruction or around a curve.

The skate has an interior cylindrical port capable of accepting tubing located at the center of the skate body. The port may be made adjustable so that tubing of various diameters may be inserted and secured. Particularly preferred diameters of injected coiled tubing are 1 inch, 1.25 inch, 1.5 inch, 1.75 inch, 2 inch, 2.375 inch, 2.75 inch, or greater nominal outer diameter.

Once the tubing is inserted into the cylindrical port, the port is adjusted until the skate firmly holds the tubing. The adjustment may be by the same clamp or bolts used to close and secure the cylindrical body. The clamping and holding portion of the skate apparatus may be on one end of the skate apparatus, with the arms and wheels on the other end of the skate apparatus. This allows the device to be secured and bolted with less possibility of damage to the arms and wheels. In one embodiment, the axles also serve as securing bolts for the skate apparatus.

Advantageously, an adapter grip spool that fits securely inside the cylindrical body can be used when the diameter of the injected tubing is smaller than the diameter of the interior of the cylindrical body. Using adapter grip spools allows a skate assembly designed for 1 and ¼ inch tubing to be used with, for example, 1 inch tubing.

Advantageously, the axles of the skate may be shortened or lengthened and the angles may be varied depending upon the diameter of the pipe and the application of the skate. It is usually preferable to have multiple skate assemblies of various sizes. However, an extension cover that fits securely over the skate, and that has three or four arms and one or more wheels on the distal end of each of the arms, that extend the reach of the arms, can be used under certain circumstances.

The skate body material is not critical so long as the skates are able to withstand the conditions they are subjected to within the pipe. Often the conditions may include extreme temperatures, pressures, and corrosive chemicals. In addition, there is a large amount of stress on the skates when the skates are supporting long lengths of injected tubing.

In the event multiple reels of coiled tubing are used, appropriate tubing-to-tubing connectors are required. The combination of appropriate connectors and one or more of a thruster pig and a skate apparatus will allow multiple reels of coiled tubing to be injected into the well or pipeline. In the event the injected tubing requirements would be for more than 15,000 feet, or there is a weight restriction due to the crane size or an offshore or inland platform, more than one spool of pipe can be connected below the injector head. The connection can be by any means known to the art. However, it is beneficial to have one or more skates near to or integral with the connecting means.

The instant invention also utilizes one or more thruster pigs that utilize a pressure differential to inject tubing down a pipeline. The thruster pig device firmly attaches to the injected tubing, and as a practical matter usually attaches at or near the distal end, i.e., the injected end, of the tubing. The thruster pig may, under certain circumstances, be advantageously placed further back on the injected tubing. There may also be occasions where more than one thruster pig is attached to a line of tubing.

The thruster pig may attach to the tubing by any conventional method. One preferred method is to use standard releasing subs, known in the art, that allow the thruster pig to be released by pumping a ball down the injected tubing. The attachment point may also contain a hinge, ball joint, swivel joint, or any combination of these that allows the thruster pig to more easily orient itself in the pipe. It is advantageous that the releasing sub or other connecting means have a stabilizer, also called a centralizer, so that if the thruster pig is left in the pipe after withdrawing the injected tube, then going to retrieve the thruster pig with a fishing operation will be facilitated. The centralizer can be a skate apparatus, and can be either integral with or attached to the thruster pig.

Finally, it may be beneficial to pump off the thruster pig that is connected to the injected tubing by releasing subs. The releasing sub may trap the ball, thereby closing off the bore in the thruster pig. The thruster pig can then be forced ahead through the pipe until a location is reached where the pig can be removed. This will sweep debris ahead of the pig, cleaning the pipe. The injected tubing is withdrawn without the thruster pig.

The diameter of the thruster pig in some plane is about the same diameter as the interior of the pipeline. The body of the thruster pig has an outer diameter greater than the outer diameter of the injected tubing and equal to or smaller than the inner diameter of the pipe. The shape of the thruster pig is not important, so long as the thruster pig makes essentially a fluid-tight seal between the injected tubing and pipe. "Essentially fluid-tight seal" means the thruster pig is "sealingly engaged" to the pipe, i.e., that the thruster pig is a substantial restriction to flow of fluids. Pressure is usually supplied by a pump, and the thruster pig will remain operable so long as the restriction to flow is sufficient to allow the pump to increase the pressure in the annulus to the desired level.

The sealing means necessarily exerts a frictional force between the thruster pig and the surface of the pipe. For a given pipe and sealing means, the tighter the seal, the greater the friction.

The thruster pig moves relative to the internal surface of the pipeline as pressure is applied to either the back or the front of the pig. The thruster pig has a sealing apparatus, for example one or more chevrons, to impede fluid migration between the body of the thruster pig and the inner surface of the pipe. This effectively creates an annulus between the injected tubing and the pipe so that pressure can be applied to the back or the front of the thruster pig. Seals prevent substantial quantities of fluids from flowing between either the tubing and the thruster pig and between the thruster pig and the interior surface of the pipeline. The seal between the injected tubing and the thruster pig can be a metal weld, a screw type seal, a compression type seal, or any other seal known to the art. The thruster pig is adapted to form a seal to the interior surface of the pipe. The seals can be any type of seal, including extrusions, cups, chevrons, disks, or a combination of these. The seal or seals are preferably cups as depicted in FIG. 3 and as are used in the art for pipeline pigs. The material of the seals is advantageously elastic so that it can move past obstructions in the pipeline while maintaining some sealing capability, and then re-forming an essentially fluid-tight seal after passing the obstruction.

A bore through the thruster pig allows fluid to be injected through the injected tubing and through the thruster pig into the pipeline ahead of the thruster pig. This bore may contain the injected tube, or it may be a continuation of that flow path. When the thruster pig is moving forward, fluid may be withdrawn from the volume ahead of the pig through this aperture.

Depending on the application, many different tools may be attached to the thruster apparatus. Tools are generally attached to the front of the thruster pig. A high pressure nozzle, wash or jet tool, drills, hammers, and other oil field tools may be attached to the end of the coiled tubing extended reach system to help remove paraffin, scale, hydrates, sand, or other debris as may be encountered. For instance, if cleaning of the pipe is necessary, a jet washer tool that sprays water or other chemicals at the walls of the pipe may be attached. The pumped fluids can be of any conventional type, such as acids, chemicals, lubricating fluids, solvents, surfactants, water, alcohol, and the like. Beneficially, the sealing means should be compatible with the injected fluid.

The thruster apparatus advantageously has one or more valves, in series or in parallel, that allow the user to pump fluids to pass through the thruster pig to the annulus behind the thruster pig. These valves are often check valves. The check valves let the fluids injected down the tubing to circulate through the annulus and out of the pipe. The check valves are actuated by pressure ahead of the thruster pig being higher than pressure behind the thruster pig.

In a second embodiment of the invention, a plurality of check valves or other valves are present that allow flow in each direction. The check valves are actuated by pressure differential across the thruster pig. The second set of valves or check valves allows fluids under some conditions to flow from the annulus between the tubing and the interior surface of the pipe to the front of the pig. These check valves may be actuated by higher pressure differentials, for example by 50 to about 1000 psi, across the thruster pig. These check valves are limits on the pressure that can be exerted against the back of the thruster pig during injection, as they will open and allow fluid to pass. These valves may be activated by any other mechanism known to the art, including electric switches, a second injected control tubing, or an injected ball, or the like. These valves are advantageously open when the thruster pig is being withdrawn, so that any fluids that are behind the thruster pig can move to the front of the thruster pig, and therefore need not be swabbed from the well.

When fluid is pumped into the annulus near the entrance of the tubing, the thruster pig and the attached tubing will be urged into the pipe up to a first maximum force determined by the annular area and the differential pressure across the thruster pig, wherein the maximum differential pressure is the operating differential of the first relief valve. Similarly, when fluid is pumped into the bore of the tubing, the fluid flows out the distal end, through the second relief valve, into the annulus and back to the entrance end. The thruster pig and tubing will be urged out of the pipe up to a second maximum force determined by the annular area and the differential pressure across the thruster pig, wherein the maximum differential pressure is the operating differential of the second relief valve. Pressure is usually supplied by a pump, and the thruster pig will remain operable so long as the restriction to flow is sufficient to allow the pump to increase the pressure in the annulus to the desired level.

In a third embodiment of the invention, a plurality of thruster pigs are attached on the injected tubing, either closely spaced or not closely spaced. Check valves that allow fluid to flow from behind the thruster pigs to the front of the thruster pigs are pressure activated, and therefore limit the pressure differential, and the thrust developed by each pig. If two or more thruster pigs are placed in a string and flow is pumped down the annulus, they each can provide a force of 100 psi differential times the annular piston area of the thruster pig. This force would be input into the coiled tubing at the location of the differential pigs instead of just at the ends.

In a fourth embodiment of the invention the thruster pig has a means to attach the body to the tubing having a first position to allow the tubing string to be run through the thruster pig while the pig is held in a stationary position. The thruster pig can then travel to a second predetermined location wherein the thruster will engage the tubing and lock the thruster pig to the tubing. Once engaged, the thruster pig and the tubing will move together.

The tubing, with the skates either integral with or attached to it, may be inserted into and withdrawn from a pipe by any means. Generally, the means employed is dependent upon the length of tubing to be inserted, as well as, the design of the pipe, i.e., straight, curved, right angle bends, etc. In most instances, the longer the tubing and the more the pipe is curved or bent, the more force that may be required to insert the tubing in the pipe.

It may sometimes be desirable to include a coupling tool or a pipe connector for attaching check valves, thruster pigs, multiple thruster pigs, release subs, and connecting one or more reels of coiled tubing together. The combination of tools and the spacing will be obvious to one skilled in the art given the disclosure herein The instant invention also is a method for withdrawing injected tubing from pipe. The method comprises opening a normally closed aperture through the body of a thruster pig. This aperture then allows fluid migration from the annulus to the pipe that is ahead of the thruster pig. Optionally, pressure may be exerted through the injected tubing to the pipe ahead of the thruster pig. The pressure builds until it is greater than the pressure in the annulus behind the thruster pig and provides a portion of the force needed to withdraw the injected tubing from the pipe. The thruster pig can, with the appropriate pressure differential, apply 30,000 pounds or more of thrust. This pressure may be limited by the check valves that allow fluid circulation, or by the mechanical strength of the tubing or thruster pig.

EXAMPLE

A test facility to simulate 5 miles extended reach in degree of difficulty was built of 6 5/8" outer diameter pipe. The test facility had about 900 feet of pipe in a horizontal plane sloping downwardly at 1/16" per foot. There were four 90 degree turns with a radius of 25 feet. The pipeline was confirmed to be equal in difficulty to a five mile pipeline in that standard coiled tubing could not be pushed through the pipeline, but would instead helically buckle and lock itself from moving further into the pipeline.

A paraffin plug was formed at the end of the pipeline opposite to where the coiled tubing was injected.

The skates used were similar to those shown in FIG. 3. One skate was placed at the end of the injected coiled tubing approximately one foot from a high pressure jet tool adapted to spray straight ahead as well as sideways to clean the pipe. A second skate was placed 25 feet from the first skate and a third skate was placed 50 feet from the second skate. Seven more skates were placed on the tubing at intervals of 100 feet. The coiled tubing was thrust into the pipeline and drag was measured every 200 feet. The injector head had a counterbalance (safety) valve that required 250 psi. to open it and allow the injector head to start moving. During operations of moving the string of coiled tubing to the wax plug, the required pressure did not exceed the 250 psi. of the counterbalance valve at running speeds up to 45 feet/minute. The coiled tubing moved smoothly into the pipeline until the wax plug was encountered and the movement stopped.

EXAMPLE

A four inch pipeline that had been shut in for many years was selected to test the skate apparatus. The pipeline had an obstruction at a distance of about 1 mile. The injected tubing was 1.25 inch coiled tubing. There were 2 turns, forming an "S" curve, with a turning radius of about 26 inches just below the work desk. The thrust required to inject the tubing past this "S" curve was 2300 pounds. The coiled tubing was injected until the obstruction was encountered at 1 mile. The coiled tubing was then alternately run back and forth from the "S" curve to the obstruction until the installed skate apparatuses had about 50,000 feet of total running distance. The skates showed no signs of failure. The coiled tubing was removed and injected without skates. The friction drag without skate apparatuses was 0.42 pounds per foot. The friction drag with skate apparatuses was 0.19 pounds per foot.

What is claimed is:

1. A method of injecting tubing having an entrance end and a distal end into partially horizontal pipe which has a larger diameter than said tubing, said method comprising:

(a) feeding tubing into the pipe, (b) attaching a thruster pig within about 5000 feet of the distal end of the tubing which is inserted into the pipe, said thruster pig comprising:

(1) a body having an inner diameter greater than the outer diameter of the injected tubing and having an outer diameter equal to or smaller than the inner diameter of the pipe;

(2) an attaching apparatus adapted to attach the device to the end of the small diameter tubing or to the exterior of the small diameter tubing;

(3) a sealing apparatus to impede fluid migration between the body of the device and the inner surface of the pipe;

(4) an aperture allowing fluids pumped down the interior of the injected tubing to pass through the device into the interior of the pipe ahead of the device; and (5) a means for allowing fluids to flow back through the device and up the annulus; and (c) exerting pressure against said thruster apparatus, thereby causing the thruster pig to exert at least a portion of the force necessary to inject the tubing down the pipe.

2. The method of claim 1 further comprising attaching one or more skate apparatuses to said tubing at predetermined distances from the distal end, said skate apparatuses comprising:

(a) a body with a diameter greater than the diameter of the tubing, said body having a cylindrical port capable of fitting around a portion of the tubing and said body being openable lengthwise by an amount sufficient to insert the injected tubing;

(b) an attaching means to securely attach the body to the exterior of the tubing; and (c) at least one set of three or four rigid arms extending in a plane in a direction toward the interior surface of the pipe, wherein each of said arms comprises one or more wheels capable of movable communication with the inner surface of said pipe, and wherein the radius from the center of the injected tubing to the outermost edge of the wheels or rollers is between about 0.5 times and about 0.95 times the radius of the pipe.

3. The method of claim 1 wherein the tubing comprises coiled tubing.

4. The method of claim 1 wherein the injected tubing comprises a plurality of reels of coiled tubing connected by connecting means.

5. The method of claim 4 wherein at least one of the connecting means has a skate apparatus attached to the connection means or attached to the tubing within about 50 feet of the connecting means.

6. The method of claim 1 wherein the injected tubing is injected into the partially horizontal pipe to a distance of at least about 6000 feet.

7. The method of claim 1 wherein the injected tubing is injected into the partially horizontal pipe to a distance of at least about 26,000 feet.

8. The method of claim 1 wherein the injected tubing is injected into the partially horizontal pipe to a distance of at least about 60,000 feet.

9. The method of claim 1 wherein the thruster pig is attached within 2000 feet of the end of the injected tubing.

10. The method of claim 2 wherein the tubing is fed into the partially horizontal pipe with an injector head, and wherein the skate apparatuses are attached to the injected tubing between the injector head and the pipe.

11. The method of claim 1 wherein the thruster pig is attached to the injected tubing with a releasing sub, and further comprising activating the releasing sub with the thruster pig in the pipe, wherein the thruster pig is transported further along the pipe by pumping without being attached to tubing.

12. The method of claim 1 further comprising adding one or more additional thruster pigs to the tubing, wherein said additional thruster pigs can be attached anywhere on the tubing.

13. The method of claim 12 wherein the thruster pig comprises means for allowing fluids to flow back through the device and up the annulus are pressure actuated check valves that actuate at between about 0.01 psi and about 10 psi, and further comprising pressure actuated check valves for allowing fluids to flow from the annulus to the front of the device that actuate at between about 50 psi and about 1000 psi.

14. The method of claim 1 wherein the attaching apparatus comprises one or more releasing subs, a hinge, a ball joint, a swivel joint, or any combination of these elements.

15. A method of injecting tubing into a pipe which has a larger diameter than said tubing, thereby forming an annulus between said tubing and said pipe, said tubing string having an entrance end and a distal end, said method comprising (a) inserting the tubing through at least one thruster pig, said thruster pig comprising:

(1) a means to sealingly engage the tubing;

(2) an inner bore through which the tubing may pass;

(3) a means to securely grip the tubing; and (4) a means to allow fluid flow from ahead of the thruster pig to the annulus behind the thruster pig;

(b) attaching the thruster pig to the exterior of the tubing, said thruster pig sized to sealingly engage both the tubing and the interior diameter of the pipe, (c) injecting said thruster pig into the pipe, (d) injecting fluid into said pipe, said fluid imparting a force into said thruster pig to move said tubing string further into said pipe.

16. The invention of claim 15 where said one or more thruster pigs are held in a stationary position as the tubing is run through the inner bore and said one or more thruster pigs are individually locked onto said tubing at different locations along said tubing.

17. The invention of claim 15 wherein flow in the bore of said tubing from said entrance end to said distal end and returning to said entrance end of said pipe through the annular area between said tubing string and said pipe flows through ports in said thruster pigs with a small enough pressure differential so as to not move the distal end of said tubing string back toward the entrance end of said pipe.

* * * * *